US011490742B2

(12) United States Patent
Gilboa

(10) Patent No.: US 11,490,742 B2
(45) Date of Patent: Nov. 8, 2022

(54) BABY AND TODDLER CARRIER WITH DETACHABLE AND ADJUSTABLE WAIST BELT

(71) Applicant: Cococho Ltd., Tel Aviv (IL)

(72) Inventor: Galit Gilboa, Salit (IL)

(73) Assignee: Cococho Ltd., Tel Aviv (IL)

( * ) Notice: Subject to any disclaimer, the term of this patent is extended or adjusted under 35 U.S.C. 154(b) by 0 days.

(21) Appl. No.: 17/275,120

(22) PCT Filed: Sep. 18, 2019

(86) PCT No.: PCT/IB2019/057861
§ 371 (c)(1),
(2) Date: Mar. 11, 2021

(87) PCT Pub. No.: WO2020/058872
PCT Pub. Date: Mar. 26, 2020

(65) Prior Publication Data
US 2022/0047095 A1 Feb. 17, 2022

Related U.S. Application Data

(60) Provisional application No. 62/732,585, filed on Sep. 18, 2018.

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025; A41D 1/02; A41D 15/00; A41D 15/04; A41D 13/00; A41F 9/00
USPC ..... 224/158–160
See application file for complete search history.

(56) References Cited

U.S. PATENT DOCUMENTS

| | | | | |
|---|---|---|---|---|
| 3,229,873 | A * | 1/1966 | Hershman | A47D 13/025 224/160 |
| 6,415,969 | B1 * | 7/2002 | Higuchi | A47D 13/025 224/159 |
| 8,272,546 | B2 * | 9/2012 | Leistensnider | A47D 13/025 224/158 |
| 9,439,516 | B2 * | 9/2016 | Workman | A47D 13/025 |
| 9,545,159 | B2 * | 1/2017 | Wang | A47D 13/025 |
| 9,848,713 | B2 * | 12/2017 | Rosen | A47D 13/025 |
| 10,433,656 | B2 * | 10/2019 | Lundh | A47D 13/025 |
| 10,441,090 | B2 * | 10/2019 | Lehan | A47D 13/025 |
| 10,702,074 | B2 * | 7/2020 | Najafi | A47D 13/08 |
| 10,716,411 | B2 * | 7/2020 | Plested | A45F 3/14 |
| 10,736,436 | B2 * | 8/2020 | Telford | A47D 13/025 |
| 10,912,394 | B1 * | 2/2021 | Young | A47D 13/02 |
| 2018/0206653 | A1 * | 7/2018 | Andrus | A47D 13/025 |

* cited by examiner

*Primary Examiner* — Adam J Waggenspack
(74) *Attorney, Agent, or Firm* — The Law Office of Joseph L. Felber

(57) ABSTRACT

A child carrier having a waist belt attached to a bottom support of the child carrier, where the waist belt is adjustable from a first position along the bottom support to a second position along the bottom support, thereby to change the size of the seat formed in the child carrier, and to facilitate carrying of different sizes of children in an ergonomically safe way. The child carrier may also be used in an ergonomically safe way, for children of specific sizes, when the waits belt is fully detached from the bottom support.

20 Claims, 7 Drawing Sheets

BABY AND TODDLER CARRIER WITH DETACHABLE AND ADJUSTABLE WAIST BELT

FIELD AND BACKGROUND OF THE INVENTION

The present invention relates to a baby and toddler carrier, and in particular to baby and toddler carrier having a detachable waist belt which is adjustable to different child sizes, where adjustment of the waist belt adjusts the size of a seat portion of the carrier, thus ensuring proper placement of the legs of the child being carried, and adapting to the child's development.

The use of baby carriers has recently been increasing, both in the average number of hours per day a baby is in a carrier, and in the range of ages of carried babies. As such, most of the baby carriers on the market include a waits belt intended to improve the weight distribution of the baby's weight, and to ease the load on the shoulders of the adult carrying the baby. The waist belt is similar to waist belts common in backpacks for hikers who carry heavy loads for a long time, and can be adjusted to the circumference of the waist of the person carrying the load.

Additionally, there has been much discussion regarding the positioning of the baby's legs while in the carrier, which affects the development of the baby's pelvis. Research has shown that use of baby carriers in which the baby's legs hang downward, similarly to how they would hang from a parachute harness, may increase the risk of hip dysplasia, particularly during the first few months in which the hip joint is developing. As such, it is important that the baby carrier have ergonomic support for the baby's thighs, which will ensure the recommended leg position at the hip joint which allows for good development of that joint, and does not damage it. Immediately after birth, it is important to start carrying the baby when his legs are folded like frog legs, while at a later stage one can move to support at a wide spread of the legs which correctly positions the top of the baby's hip bone in the hip joint.

Some existing baby carriers provide various solutions for adjusting the carrier to the position of the baby's legs at different stages of development. However, there is still a need in the art for a child carrier which is suitable for carrying new-born babies, larger babies, and toddlers, while being adjustable so as to keep the legs of the child in an ergonomically recommended position, similar to that of the letter 'M', and at the same time distributing the weight of the growing baby between the parent's shoulders and waist.

Moreover, with newborn babies which are very light, there is a need in the art for a carrier which enables the recommended positioning of their thighs, while there is not necessarily a need for a waist belt to distribute their weight on the adult body. For a mother that gave birth by a C-section, the waist belt might even cause discomfort.

SUMMARY

The present invention relates to a baby and toddler carrier having a detachable and adjustable waist belt, where adjustment of the waist belt causes a bottom support to be suited to the dimensions and leg positioning of the child being carried, and adjusts the size of a bottom portion of the carrier, thus ensuring proper anatomical arrangement of the legs of the child being carried.

As such, according to some embodiments of the present invention, there is provided a child carrier adapted to be worn by an adult wearer to carry a child therein, the child carrier including:

a back panel, adapted to support a back of the child when the child is placed in the child carrier;

a bottom support, connected to the back panel, and adapted to form a seat suitable for supporting a lower body portion of the child when the child is placed in the child carrier;

at least one shoulder strap, attached at one end thereof to the back panel and at an opposing end thereof to the bottom support, the at least one shoulder strap adapted to be placed over a shoulder of the adult wearer when the child carrier is worn by the adult wearer; and a waist belt adapted to surround a waist of the adult wearer when the child carrier is worn by the adult wearer, wherein the waist belt is adapted to be attached to the bottom support at a first position such that the seat formed by the bottom support has a first size, and is adapted to be attached to the bottom support at a second position such that the seat formed by the bottom support has a second size, the second size being larger than the first size.

In some embodiments, when the waist belt is attached to the bottom support in the first position, the seat is suitable for carrying a child, with legs of the child extending out of the bottom support and being supported in an anatomically healthy hip position.

In some embodiments, when the waist belt is attached to the bottom support in the second position, the seat is suitable for carrying a child with legs of the child extending out of the bottom support and being supported in an anatomically healthy hip position.

In some embodiments, when the waist belt is attached to the bottom support in the second position, the seat is suitable for carrying an infant with legs of the infant tucked inside the bottom support.

In some embodiments, when the waist belt is attached to the bottom support in the first position, the seat is suitable for carrying an infant with legs of the infant tucked inside the bottom support.

In some embodiments the waist belt includes a first portion and a second portion, each of the first portion and the second portion having a first end and a second end, the first ends of the first and second portions are adapted to be clasped to one another about a waist of the adult wearer, the bottom support has disposed, on a surface thereof, a first pair of attachment mechanisms disposed at the first position, and a second pair of attachment mechanisms disposed at the second position, and the second ends of the first and second portions are adapted to be attached to the first pair of attachment mechanisms to form the seat of the first size and are adapted to be attached to the second pair of attachment mechanisms to form the seat of the second size.

In some embodiments, at least one of the first pair of attachment mechanisms or the second pair of attachment mechanisms includes a pair of zippers, adapted to engage corresponding zippers on ends of the first and second portions of the waist belt.

In some embodiments, when transitioning from attachment to the first pair of attachment mechanisms to attachment to the second pair of attachment mechanisms, the first and second portions of the waist strap are at least partially detached from the bottom support.

In some embodiments, when transitioning from attachment to the first pair of attachment mechanisms to attachment to the second pair of attachment mechanisms, the first and second portions of the waist strap are fully detached from the bottom support.

In some embodiments, the first pair of attachment mechanisms are disposed horizontally closer to each other on the bottom support than the second pair of attachment mechanisms.

In some embodiments, the first pair of attachment mechanisms are disposed closer to a lower edge of the bottom support, than the second pair of attachment mechanisms.

In some embodiments, the attachment mechanisms of the first pair of attachment mechanisms and of the second pair of attachment mechanisms are disposed at an angle relative to a longitudinal axis of the back panel, such that transitioning of the first and second portions from attachment at the first position to attachment at the second position simultaneously changes the height and the width of the bottom support formed by the bottom support.

In some embodiments, the attachment mechanisms of the first pair of attachment mechanisms are disposed at an angle relative to each other.

In some embodiments, the at least one shoulder strap includes a pair of shoulder straps, each attached to one side of the back panel and to one side of the bottom support.

In some embodiments, the bottom support has at least one side extension extending outwardly therefrom on at least one side thereof, and the at least one shoulder strap is connected to the bottom support by connection to the at least one side extension.

In some embodiments, the at least one shoulder strap includes a pair of shoulder straps and the at least one side extension includes two side extensions on opposing sides of the bottom support, and wherein each the shoulder strap is attached to one side of the back panel and to one of the side extensions attached to the bottom support.

In some embodiments, the back panel includes a harness on an interior surface thereof, the harness adapted to anchor the child being carried to the back panel.

In some embodiments, the child being carried is a baby, and wherein, when the waist belt is fully detached from the bottom support, the harness on the interior surface is suitable to position the baby's thighs in the recommended leg position to facilitate safe carrying of the baby.

In some embodiments, the harness on the interior surface is adjustable to a size of the thighs of the child.

BRIEF DESCRIPTION OF THE FIGURES

Some embodiments of the invention are described herein with reference to the accompanying figures. The description, together with the figures, makes apparent to a person having ordinary skill in the art how some embodiments of the invention may be practiced. The figures are for the purpose of illustrative discussion and no attempt is made to show structural details of an embodiment in more detail than is necessary for a fundamental understanding of the invention. For the sake of clarity, some objects depicted in the figures are not to scale.

In the Figures.

DESCRIPTION OF SOME EMBODIMENTS OF THE INVENTION

Figure 1:
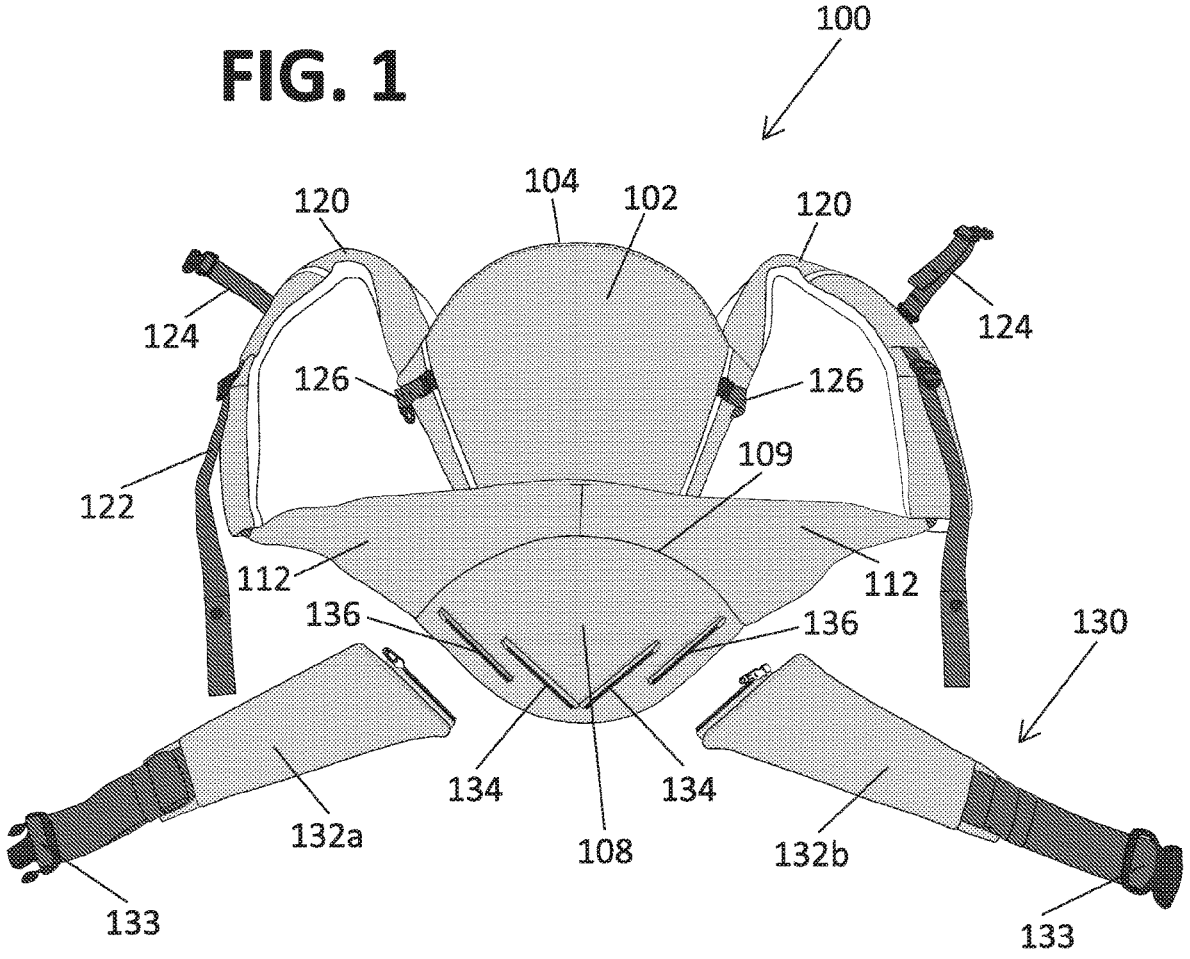
FIG. 1 is a planar exterior view illustration of a child carrier according to an embodiment of the teachings herein, where two portions of waist belt of the child carrier are detached from a bottom support of the child carrier.

The present invention relates to child carriers having an adjustable waist belt which allows at least two sizes and positions for baby legs.

The principles, uses and implementations of the teachings herein may be better understood with reference to the accompanying description and figures. Upon perusal of the description and figures present herein, one skilled in the art is able to implement the invention without undue effort or experimentation.

Before explaining at least one embodiment of the invention in detail, it is to be understood that the invention is not limited in its applications to the details of construction and the arrangement of the components and/or methods set forth in the following description and/or illustrated in the drawings and/or the Examples. The invention can be implemented with other embodiments and can be practiced or carried out in various ways. It is also understood that the phraseology and terminology employed herein is for descriptive purpose and should not be regarded as limiting.

In the context of the present application and claims, the term "child" relates to a human of substantially small weight and height, suitable for being carried in a carrier according to the present invention, including a new-born baby, a baby and a toddler.

In the context of the present application and claims, the terms "new-born", "new-born baby", and "infant", are used interchangeably, and relate to a human child in the age range of 0-3 months, whose muscles are still used to the position held in the womb such that it is hard to spread their legs, and whose body typically tends to curl into a fetal position.

In the context of the present application and claims, the term "small baby" relates to a human typically older than 3 months, which typically can hold their head up, but cannot stand, or walk independently.

In the context of the present application and claims, the terms "toddler" and "big baby" may be used interchangeably, and relate to a human child who can walk independently, which is typically in the age range of 9 months or one year to 4 years.

It is appreciated that the terms "infant", "small baby", and "big baby" or "toddler" are more dependent on the dimensions of the baby, than on the age of the baby. However, in order to clarify the use of the invention, the terms are defined relative to a child who is in the $40^{th}$ to $60^{th}$ percentile in terms of height and weight.

In the context of the present application and claims, the term "ergonomically healthy position" of a child's legs relates to a position in which the hips and thighs, above the knee, are supported in a leg spread or such that the legs form the shape of the letter 'M', with the buttocks being at the midpoint of the 'M', and the lower legs, below the knee, extend downward.

In the context of the present application and claims, the terms "clasp", "clasping mechanism", and "attachment mechanism" are used interchangeably, and relate to any mechanism suitable for connecting two elements or straps, such as clasps and corresponding housings for receiving the clasps, hook and eye mechanisms, zippers, buttons and corresponding button loops, corresponding Velcro® hook and loop materials, snaps, tracks and sliders and the like.

Reference is now made to FIG. 1, which is a planar exterior view illustration of a child carrier 100 according to an embodiment of the teachings herein. As seen in FIG. 1, the child carrier includes a back panel 102 adapted to support the back of a child disposed within the carrier. In some embodiments, the back panel 102 includes a top edge 104, in an area at which the head of the child is adapted to rest, and a bottom edge disposed opposite top edge 104.

A bottom support 108, adapted to receive and support a lower portion of the child's body, including the child's buttocks and upper legs, is connected to the bottom edge of back panel 102, for example by a seam 109. In some embodiments, the bottom support includes side extensions 112, which extend on either side of the bottom support 108, substantially symmetrically.

In some embodiments, disposed along an inner side of back panel 102, is a harness (not explicitly shown), for anchoring the child to back panel 102 and/or to bottom support 108. An example of such an anchoring mechanism is described in U.S. Pat. No. 9,241,582, which is incorporated by reference for all purposes as if fully set forth herein.

Child carrier 100 further includes a pair of shoulder straps 120, adapted, when the child carrier is worn by a parent or other caregiver, to be positioned over the shoulders of the parent. In the illustrated embodiment, each of shoulder straps 120 extends along one side of back panel 102, and terminates at an end of one of side extensions 112. However, it will be appreciated that the shoulder straps may have any suitable arrangement or structure, including arrangements and structures known in the art, provided that the shoulder straps enable the parent to wear the carrier on their shoulders.

In some embodiments, each of shoulder straps 120 includes a shoulder-strap adjustment mechanism 122, for adjusting the length of the shoulder straps to be suited to the size of the adult wearing the child carrier.

In some embodiments, chest straps 124 extend from shoulder straps 120, the chest straps terminating in a clasping mechanism. The chest straps 124 are adapted, when the child carrier is worn by an adult wearing, to be clasped to each other against the chest of the wearer, so as to assist in providing better distribution of the weight and better support of the child carrier 100 on the body of the adult.

In some embodiments, ends 126 of a child security belt are disposed on along sides of back panel 102, and may be slidably along the sides of back panel 102 to different heights, so as to secure a child disposed within the carrier at a height suitable to the size of the child. An example of such a child security belt is described in U.S. Pat. No. 9,241,582 mentioned hereinabove.

The child carrier 100 further includes a waist belt 130, which, in the illustrate embodiment, includes a first portion 132*a* and a second portion 132*b* which are separate from one another. The waist belt is reversibly attachable to a surface of bottom support 108, here illustrated as the exterior surface, by reversible attachment of a first end of each of first portion 132*a* and second portion 132*b* to bottom support 108 using any suitable attachment mechanism, such as zippers, hooks and eyes, snaps, buttons, and the like. First and second portions 132*a* and 132*b* terminate, at a second end thereof, in a clasping mechanism 133, allowing the adult wearing the carrier 100 to clasp the waist belt 130 about their waist, thereby to provide a better distribution of the weight of the child being carried and to form the seat which is adapted to the child's size and desired leg position.

In some embodiments, not specifically illustrated, the waist belt is formed of a single portion having first and second ends, both of which are attached to bottom support 108. In such embodiments, the clasping mechanism 133 is omitted.

As seen clearly in FIG. 1, the waist belt 130 is disposed substantially perpendicularly to the carrier's axis of symmetry, and generally parallel to the ground, on both sides of the bottom support 108.

It is a particular feature of the disclosed technology that the attachment of the waist belt 130 to bottom support 108 is adjustable between multiple positions, each of which is suitable for a different size child, by changing the position of the waist belt 130 along bottom support 108. Attachment of the waist belt 130 to bottom support 108 at different positions results in different dimensions of the seat created for the child to be seated within.

In the illustrated embodiment, a first pair of zippers 134 are disposed at a first position, and a second pair of zipper 136 are disposed at a second position on the exterior surface of bottom support 108 such that first portion 132*a* and second portion 132*b* of the waist belt 130 are attachable to zippers 134 as well as to zippers 136.

As seen in FIG. 1, in some embodiments the zippers 134 are disposed on an exterior surface of bottom support 108, and are relatively close to each other. In some embodiments, the zippers 134 are angled with respect to the axis of symmetry of the carrier, such that the zippers form a 'V' shape therebetween. In some embodiments, the angle formed between zippers 134 is in the range of 1 to 120 degrees. Connection of first and second portions 132*a*, 132*b* of the waist belt to zippers 134 results in a narrower bottom supporting the bottom portion and thighs of the child, as described in further detail with respect to FIGS. 2A and 2B.

The zippers 136 are disposed on the exterior surface of bottom support 108, are more distant from each other than zippers 134 relative to the axis of symmetry of the carrier, and are higher than zippers 134 relative to a bottom edge of the bottom support. As such, a portion of each of zippers 136 is disposed between a zipper 134 and a corresponding side of bottom support 108. Since zippers 136 are of substantially the same length as zippers 134, zippers 136 terminate higher than zippers 134 relative to the bottom edge of the child carrier 100. Connection of first and second portions 132*a*, 132*b* of the waist belt to zippers 136 results in a wider bottom supporting the bottom portion and thighs of the body of the child, as described in further detail with respect to FIGS. 3A to 3C.

Figure 4:
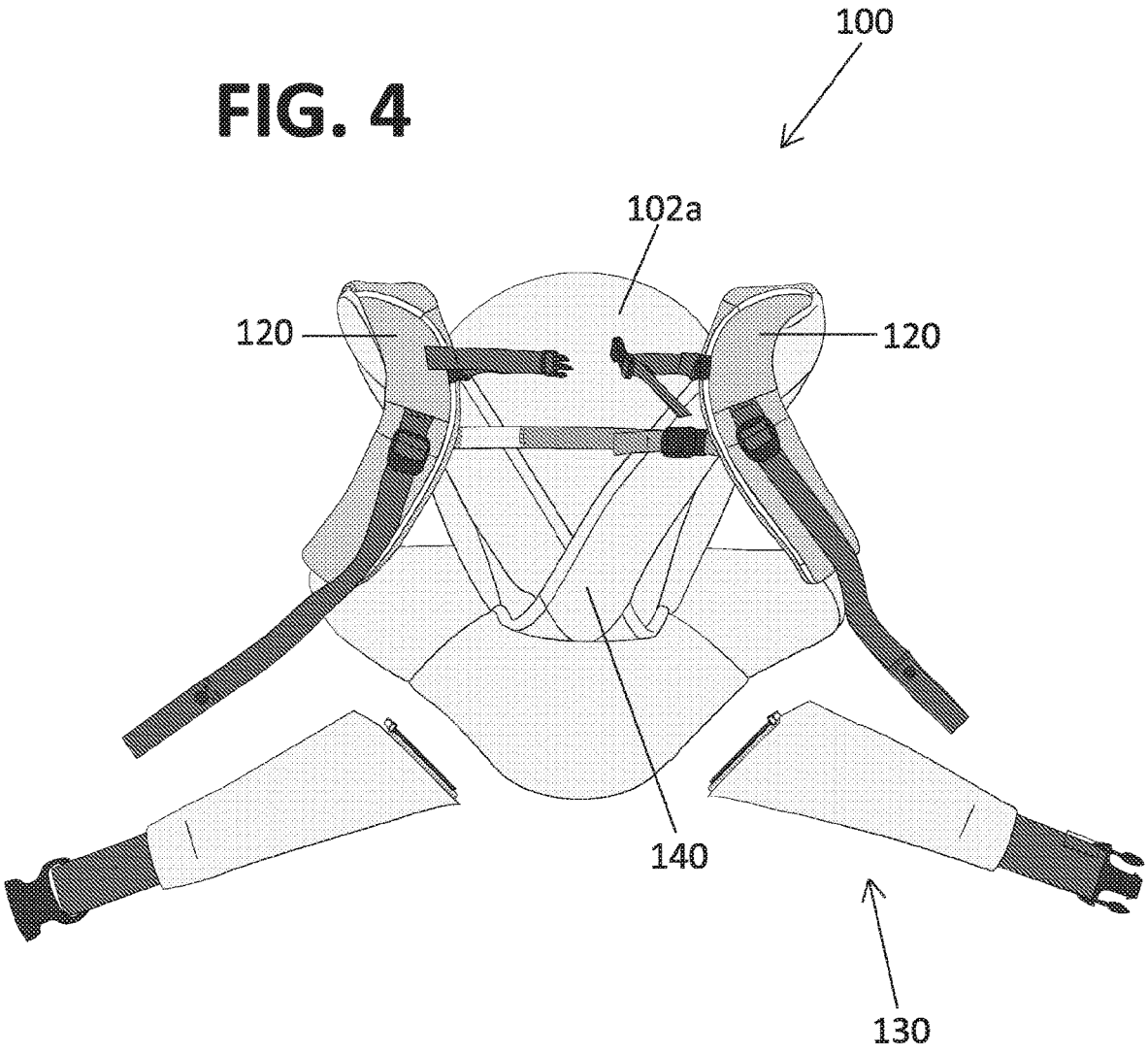
FIG. 4 is a planar interior view illustration of a child carrier according to an embodiment of the teachings herein.

Reference is additionally made to FIG. 4, which is a planar interior view illustration of a child carrier according to an embodiment of the teachings herein.

As seen in FIG. 4, in some embodiments, the inner surface 102*a* of back panel 102 has a harness 140 disposed thereon, here illustrated as a V-shaped harness. In some embodiments, ends of the harness 140 are attached to an interior surface of shoulder straps 120. Harness 140 is adapted to anchor the child being carried to back panel 102, for example by placing the child between the V-shaped straps and the back panel 102, with the tip of the V-shaped harness holding the child's crotch region, and the legs and arms of the child extending outwardly from the harness 140.

In some embodiments, in which the child being carried is an infant or a small baby, when the child is anchored to the back panel 102 using harness 140, the child may be carried safely even with waist belt 130 being fully detached from the bottom support 108. In such embodiments, harness 140 positions the baby's thighs in the recommended leg position to facilitate safe carrying of the baby.

In some embodiments, the size of harness 140 is adjustable to the size of the child being carried, for example to a size of the thighs of the child.

Figure 2A:
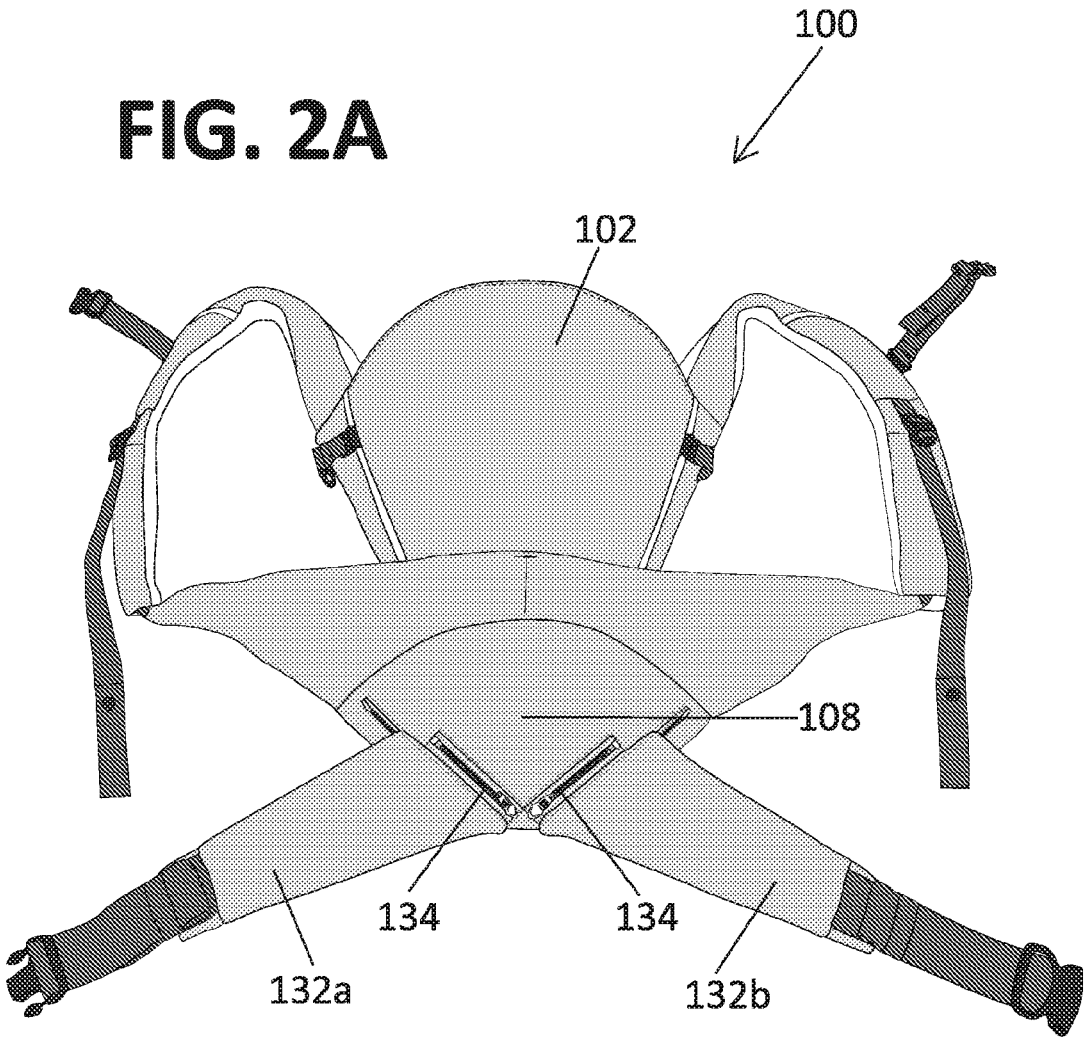
FIG. 2A is a planar exterior view illustration of a child carrier according to an embodiment of the teachings herein, where two portions of waist belt of the child carrier are attached to a bottom support of the child carrier at a first position.
Figure 2B:
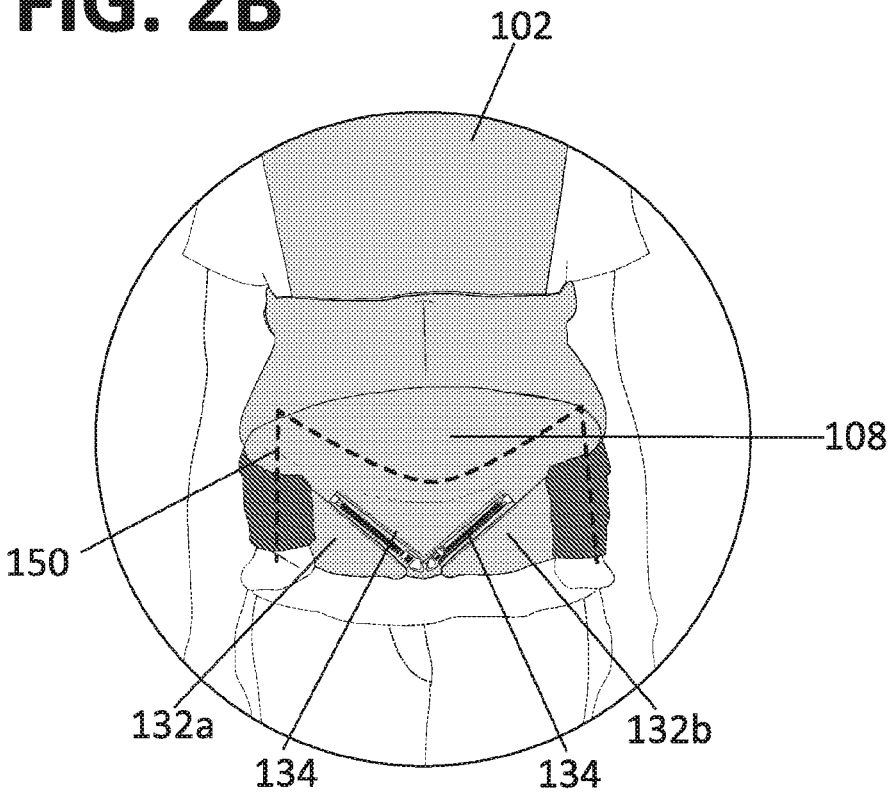
FIG. 2B is a schematic illustration of a small baby disposed within the child carrier in the orientation of FIG. 2A, when worn on the back of an adult.

Reference is now additionally made to FIG. 2A, which is a planar exterior view illustration of child carrier 100, where first and second portions 132*a*, 132*b* of waist belt 130 are attached to bottom support 108 of the child carrier at a first position, by attachment to zippers 134. As seen in FIG. 2B, when the waist belt 130 is attached to zippers 134 as illustrated in FIG. 2A, the seat formed by bottom support 108 is relatively narrow, and is suitable for supporting the bottom portion and thighs of a small baby, as defined herein. Naturally, the ages at which the attachment waist belt 130 to zippers 134 is suitable for the baby is dependent also on the relative size of the baby, such that larger or taller babies may "outgrow" this arrangement of the carrier 100 earlier than smaller or shorter babies would. As seen in FIG. 2B, the seat formed by bottom support 108 is suitable for supporting the entirety of the baby's thighs, down to the knees, such that only the lower portion of the baby's legs extends out of the carrier 100, and the baby's buttocks and thighs are arranged in an 'M' shape indicated by a dashed line 150.

It is appreciated that if one were to place a new-born infant in the carrier 100 as illustrated in FIG. 2A, the seat would be too wide for the infant to spread his legs at this stage, and for the infant's size such that the knees would be straight and the lower legs of the infant would extend outwardly generally horizontally, which is an uncomfortable and unhealthy position. Conversely, if one were to place a larger toddler in the carrier 100 as illustrated in FIG. 2A, the seat would be too narrow for the toddler's knees, such that the toddler's knees would not be supported and would dangle down beneath the height of the seat formed by seat portion 108, which is also an uncomfortable and unhealthy position.

Figure 3A:
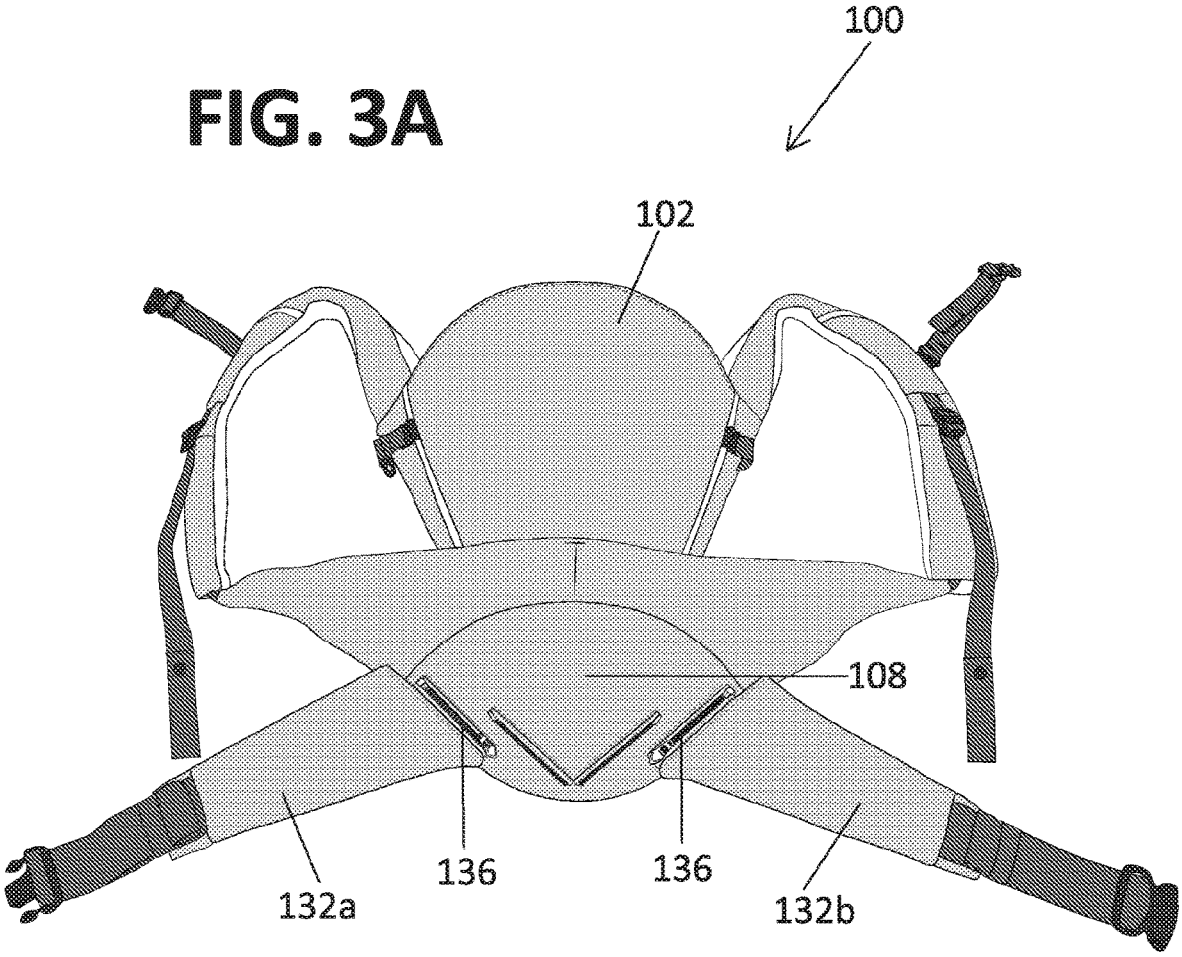
FIG. 3A is a planar exterior view illustration of a child carrier according to an embodiment of the teachings herein, where two portions of waist belt of the child carrier are attached to the bottom support of the child carrier at a second position.
Figure 3B:
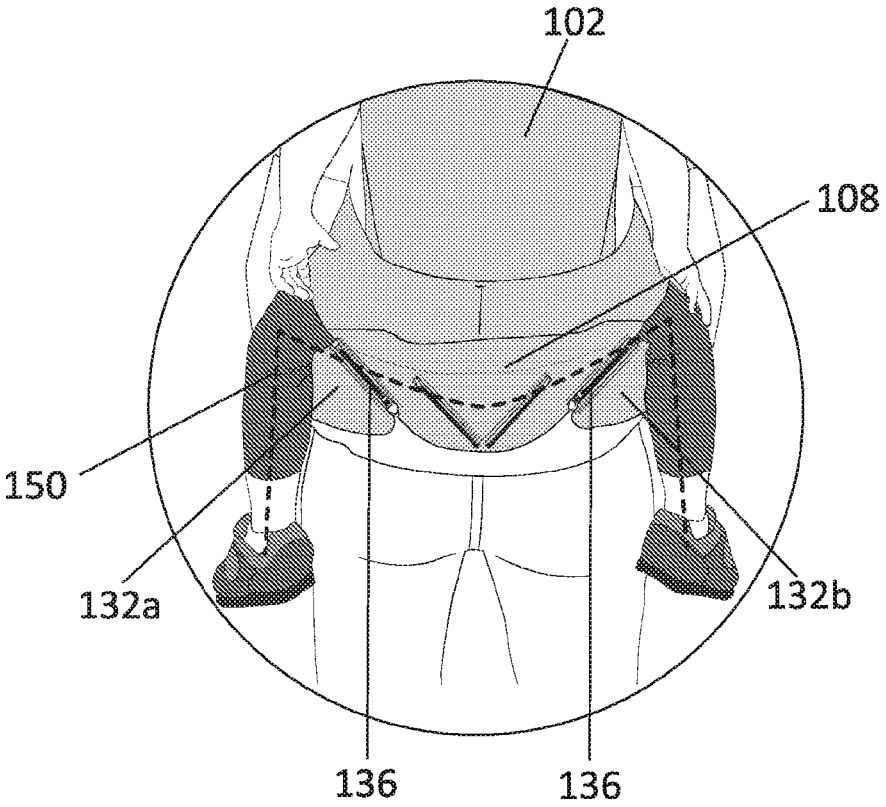
FIGS. 3B and 3C are, respectively, schematic illustrations of a toddler/large baby and a new-born child disposed within the child carrier in the orientation of FIG. 3A, when worn on an adult, the toddler/large baby being seated with a leg spread and the new-born having his legs tucked inside the bottom support.
Figure 3C:
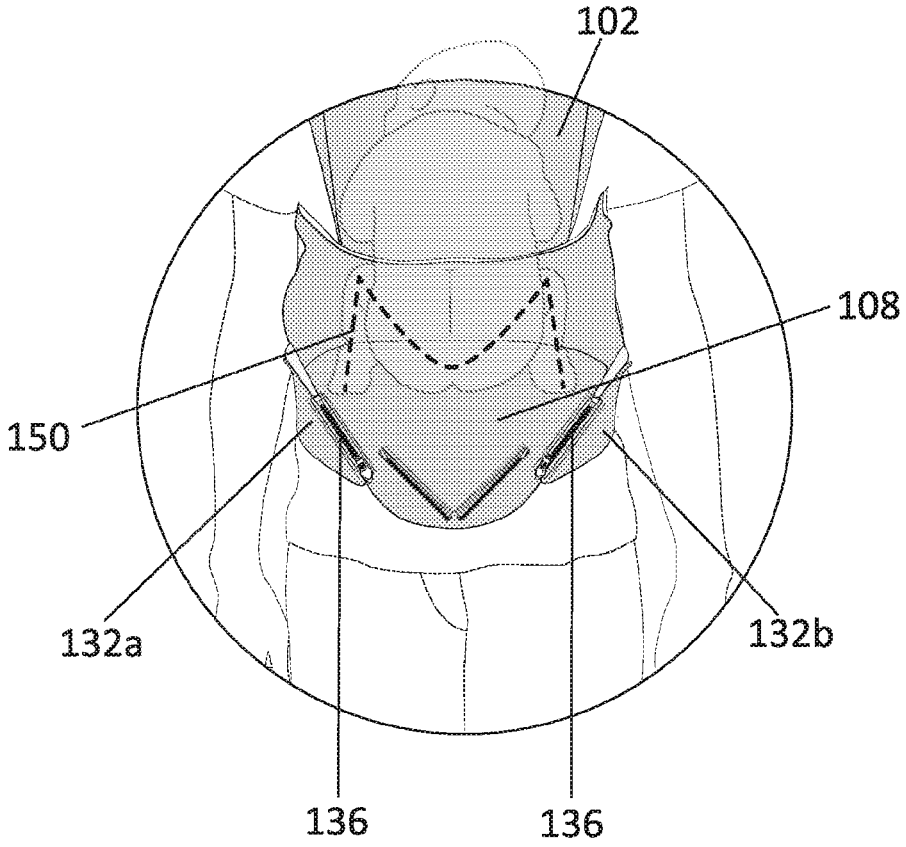

Reference is now made to FIG. 3A, which is a planar exterior view illustration of child carrier 100, where first and second portions 132*a*, 132*b* of waist belt 130 are to bottom support 108 of the child carrier at a second position, by attachment to zippers 136. As seen in FIGS. 3B and 3C, when the waist belt 130 is attached to zippers 136 as illustrated in FIG. 3A, the seat formed by bottom support 108 is relatively wide.

In some embodiments, the seat formed by bottom support 108 when waist belt 130 is attached to zippers 136 may be suitable for supporting the bottom portion of the body of a toddler, as illustrated in FIG. 3B. Naturally, the ages at which the attachment waist belt 130 to zippers 136 is suitable for the toddler is dependent also on the relative size of the toddler, such that larger or taller children may "outgrow" this arrangement of the carrier 100 earlier than smaller or shorter children would. As seen in FIG. 3B, the seat formed by bottom support 108 is wider than the seat shown in FIG. 2B, and is suitable to support the entirety of the thighs of the toddler, down to the knees, such that only the lower portion of the toddler's legs extends out of the carrier 100, and the toddler's hips and upper legs are arranged in a leg spread (an 'M' shape indicated by a dashed line 152).

In some embodiments, the seat formed by bottom support 108 when waist belt 130 is attached to zippers 134 or 136 may be suitable for supporting a new-born infant having his legs tucked within the bottom support 108 in a frog-like position, within carrier 100, as illustrated in FIG. 3C.

It is appreciated that if one were to place a baby in the carrier 100 as illustrated in FIG. 3A, the seat would be too wide for the baby's knees, such that the knees would be straight and the lower legs of the infant would extend outwardly generally horizontally, which is an uncomfortable and unhealthy position.

It is appreciated that though the child carrier 100 is described as having a specific structure, and a specific mechanism for attaching the waist belt to the bottom support, and for adjusting the attachment therebetween, any suitable mechanism for adjusting the positioning of the waist belt along the bottom support is considered to be within the scope of the present application.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

Citation or identification of any reference in this application shall not be construed as an admission that such reference is available as prior art to the invention.

Section headings are used herein to ease understanding of the specification and should not be construed as necessarily limiting.

The invention claimed is:

1. A child carrier adapted to be worn by an adult wearer to carry a child therein, the child carrier comprising:

a back panel, adapted to support a back of the child when the child is placed in said child carrier;

a bottom support, connected to said back panel, and adapted to form a seat adapted for supporting a lower body portion of the child when the child is placed in said child carrier, said bottom support has a first pair of attachment mechanisms disposed at a first position on a surface of the bottom support, and a second pair of attachment mechanisms disposed at a second position on the surface of the bottom support;

at least one shoulder strap, attached at one end thereof to said back panel and at an opposing end thereof to said bottom support, said at least one shoulder strap adapted to be placed over a shoulder of the adult wearer when said child carrier is worn by the adult wearer; and a waist belt adapted to surround a waist of the adult wearer when said child carrier is worn by the adult wearer, said waist belt comprising:

a first portion having a first end and a second end;

a second portion having a first end and a second end;

first and second portions of a clasp, disposed on said first ends of said first and second portions, respectively, adapted to allow clasping of the first and second portions to each other about the waist of the adult wearer;

wherein said second ends of said first and second portions of said waist belt are adapted to be attached to said first pair of attachment mechanisms at said first position such that said seat formed by said bottom support has a first size, and are adapted to be attached to said second pair of attachment mechanisms at said second position such that said seat formed by said bottom support has a second size, said second size being larger than said first size.

2. The child carrier of claim 1, wherein, when said waist belt is attached to said bottom support in said first position, said seat is adapted for carrying a child, with legs of the child extending out above said waist belt and being supported in an anatomically healthy hip position.

3. The child carrier of claim 1, wherein, when said waist belt is attached to said bottom support in said second position, said seat is adapted for carrying a child with legs of the child extending above said waist belt and being supported in an anatomically healthy hip position.

4. The child carrier of claim 1, wherein, when said waist belt is attached to said bottom support in said second position, said seat is adapted for carrying an infant with legs of the infant tucked inside the bottom support.

5. The child carrier of claim 1, wherein, when said waist belt is attached to said bottom support in said first position, said seat is adapted for carrying an infant with legs of the infant tucked inside the bottom support.

6. The child carrier of claim 1, wherein at least one of said first pair of attachment mechanisms or said second pair of attachment mechanisms includes a pair of zippers, adapted to engage corresponding zippers on the second ends of said first and second portions of said waist belt.

7. The child carrier of claim 1, wherein, for transitioning from said first size of said seat to said second size of said seat:

said first and second portions of said waist belt are detached from said first pair of attachment mechanisms such that said first and second portions of said waist belt are at least partially detached from said bottom support; and said first and second portions of said waist belt are re-attached to said second pair of attachment mechanisms of said bottom support.

8. The child carrier of claim 1, wherein, for transitioning from said first size of said seat to said second size of said seat:

said first and second portions of said waist belt are detached from said first pair of attachment mechanisms such that said first and second portions of said waist belt are fully detached from said bottom support; and said first and second portions of said waist belt are re-attached to said second pair of attachment mechanisms of said bottom support.

9. The child carrier of claim 1, wherein said first pair of attachment mechanisms are disposed horizontally closer to each other on said bottom support than said second pair of attachment mechanisms.

10. The child carrier of claim 1, wherein said first pair of attachment mechanisms are disposed vertically closer to a lower edge of said bottom support than said second pair of attachment mechanisms.

11. The child carrier of claim 1, wherein said attachment mechanisms of said first pair of attachment mechanisms and of said second pair of attachment mechanisms are disposed at an angle relative to a longitudinal axis of the back panel, such that transitioning of said first and second portions from attachment at said first position to attachment at said second position simultaneously changes the height and the width of said seat formed by said bottom support.

12. The child carrier of claim 1, wherein said attachment mechanisms of said first pair of attachment mechanisms are disposed at an angle relative to each other.

13. The child carrier of claim 1, wherein said at least one shoulder strap comprises a pair of shoulder straps, each attached to one side of said back panel and to one side of said bottom support.

14. The child carrier of claim 1, wherein said bottom support has at least one side extension extending outwardly therefrom on at least one side thereof, and said at least one shoulder strap is connected to said bottom support by connection to said at least one side extension.

15. The child carrier of claim 14, wherein said at least one shoulder strap comprises a pair of shoulder straps and said at least one side extension comprises two side extensions on opposing sides of said bottom support, and wherein each said shoulder strap is attached to one side of said back panel and to one of said side extensions attached to said bottom support.

16. The child carrier of claim 1, wherein said back panel includes a harness on an interior surface thereof, said harness adapted to anchor the child being carried to said back panel.

17. The child carrier of claim 16, wherein the child being carried is a baby, and wherein, when said waist belt is fully detached from said bottom support, said harness on said interior surface is adapted to position the baby's thighs and legs to form an M-shape.

18. The child carrier of claim 16, wherein said harness on said interior surface is adjustable to a size of the child.

19. The child carrier of claim 1, wherein, when said second ends of said first and second portions of said waist belt are attachable to each other only via said bottom support.

20. The child carrier of claim 1, wherein said waist belt is devoid of fixed and direct attachment to the bottom support.

* * * * *